US010858078B1

(12) United States Patent
Serapinas

(10) Patent No.: US 10,858,078 B1
(45) Date of Patent: Dec. 8, 2020

(54) SAIL BOARD FOOT REPOSITIONING SYSTEM

(71) Applicant: Dziugas Serapinas, Nantucket, MA (US)

(72) Inventor: Dziugas Serapinas, Nantucket, MA (US)

( * ) Notice: Subject to any disclaimer, the term of this patent is extended or adjusted under 35 U.S.C. 154(b) by 0 days.

(21) Appl. No.: 16/533,120

(22) Filed: Aug. 6, 2019

Related U.S. Application Data

(60) Provisional application No. 62/715,153, filed on Aug. 6, 2018.

(51) Int. Cl.

| | |
|---|---|
| ***B63B 32/50*** | (2020.01) |
| ***B63B 32/40*** | (2020.01) |
| ***B63B 32/68*** | (2020.01) |
| *B63B 35/00* | (2020.01) |

(52) U.S. Cl.
CPC ..... *B63B 32/45* (2020.02); *B63B 32/50* (2020.02); *B63B 32/68* (2020.02); *B63B 2035/009* (2013.01)

(58) Field of Classification Search
CPC ..... B63B 32/45; B63B 32/68; B63B 32/50; B63B 2035/009
See application file for complete search history.

(56) References Cited

U.S. PATENT DOCUMENTS

| | | | | |
|---|---|---|---|---|
| 1,569,885 | A * | 1/1926 | Robblee | B62B 13/04 280/25 |
| 4,871,337 | A | 10/1989 | Harris | |
| 5,021,017 | A | 6/1991 | Ott | |
| 5,931,504 | A | 8/1999 | Armitage | |
| 6,257,614 | B1 | 7/2001 | Duggan | |
| 6,789,806 | B2 | 9/2004 | Santa Cruz et al. | |
| 6,817,619 | B2 | 11/2004 | Harrison | |
| 6,910,695 | B2 | 6/2005 | Ellington | |
| 7,237,784 | B1 | 7/2007 | Monteleone | |
| 7,267,346 | B2 | 9/2007 | Zejdlik et al. | |
| 7,901,261 | B1 | 3/2011 | Rosas Zarich et al. | |
| 8,256,779 | B1 | 9/2012 | Johncsnn | |
| 8,870,615 | B2 | 10/2014 | Schulz | |
| 10,052,549 | B2 * | 8/2018 | Charkales | A63C 5/033 |
| 2002/0043774 | A1 * | 4/2002 | Chou | A63C 17/01 280/7.12 |
| 2003/0193168 | A1 * | 10/2003 | Chou | A63C 5/02 280/607 |
| 2004/0145152 | A1 * | 7/2004 | Santa Cruz | A63C 5/03 280/602 |
| 2013/0213287 | A1 * | 8/2013 | Schulz | B63B 32/00 114/39.12 |

* cited by examiner

*Primary Examiner* — Stephen P Avila
(74) *Attorney, Agent, or Firm* — John P. McGonagle

(57) ABSTRACT

A sail board foot repositioning system is provided. The sail board repositioning system has a plate assembly rotatably attached to the sail board top surface. The plate assembly provides foot attachment means and means for changing the orientation of the plate for a resulting desired foot orientation.

9 Claims, 5 Drawing Sheets

SAIL BOARD FOOT REPOSITIONING SYSTEM

BACKGROUND OF THE INVENTION

This invention relates to sail boards, and more particularly to a foot repositioning system mounted on the sailboard.

Sailboards are elongated boards with a sail mounted on a mast attached to the sailboard thereby providing air propulsion to the sailboard. Foot receptacles are mounted on the sailboard to provide means for a person riding on the sailboard to maneuver the sail board. Prior art foot receptacles typically include foot straps that the feet are placed into during planning of the sail board. The foot straps allow secure attachment of the rider's feet to the sail board. Conventional foot straps are generally fixed to the sail board and are typically non-adjustable during use.

For the rider to change the sail board's direction or adjust for a change in wind direction while the sail board is moving, the rider must remove the feet from both foot straps on one side of the sail board and reinsert them into foot straps on the other side of the sail board.

SUMMARY OF THE INVENTION

The present invention overcomes the limitations of the prior art by providing an apparatus for changing the orientation of the rider's feet on a sail board without having to remove his feet from foot straps. A sail board foot repositioning system comprised of a plate assembly rotatably attached to the board top surface has foot attachment means and means for changing the orientation of the plate for a resulting desired foot orientation.

These together with other objects of the invention, along with various features of novelty, which characterize the invention, are pointed out with particularity in the following specification. For a better understanding of the invention, its operating advantages and the specific objects attained by its uses, reference should be had to the accompanying drawings and descriptive matter in which there are illustrated preferred embodiments of the invention.

DETAILED DESCRIPTION OF THE INVENTION

Figure 1:
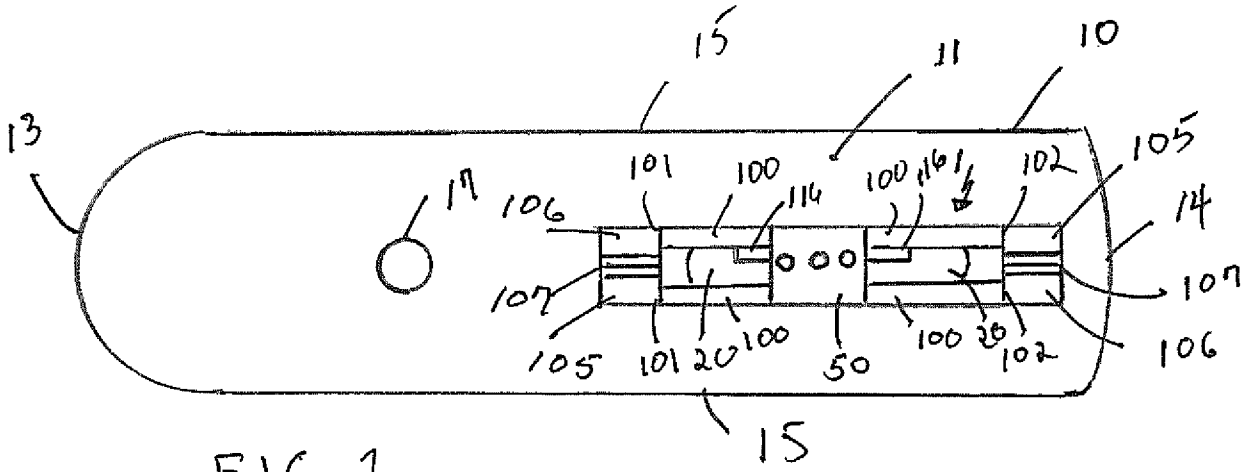
FIG. 1 is a top view of a sail board having a foot repositioning system.
Figure 2:
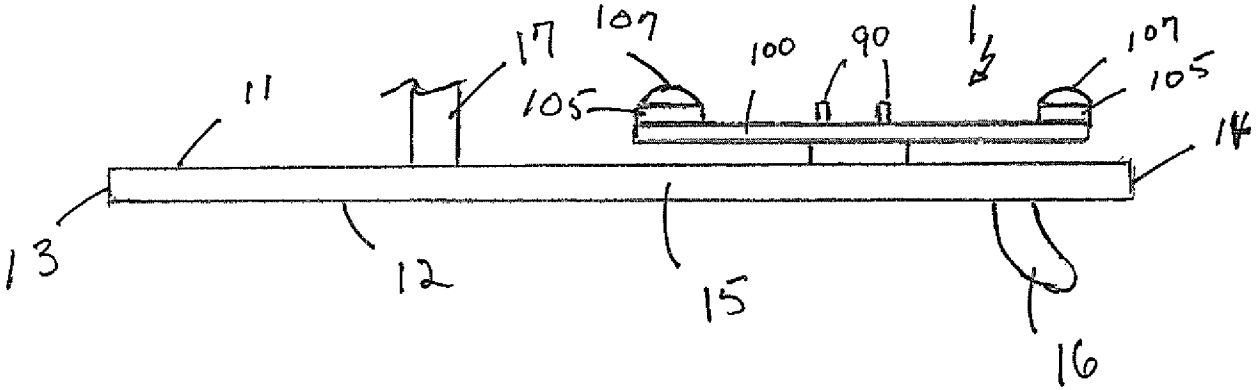
FIG. 2 is a side view of the sail board of FIG. 1.

Referring to the drawings in detail wherein like elements are indicated by like numerals, there is shown a top view of a sail board 10 with the invention foot repositioning system 1. The sail board 10 has a top surface 11, a bottom surface 12, a bow 13, a stern 14, and two elongated rails 15 interconnecting the bow and stern, said bow and stern defining a sail board longitudinal axis. The bottom surface 12 has one or more skegs 16 attached thereto generally near to the sail board stern. A mast 17 is attached to the sail board top surface 11 along a sail board central longitudinal axis, generally between a sail board longitudinal midpoint and the sail board bow. A sail (not shown) and steering bar (not shown) are removably attached to said mast. The foot repositioning system 1 is attached to the sail board top surface 11 generally between a sail board longitudinal midpoint and the sail board stern. See FIGS. 1 & 2.

Figure 3:
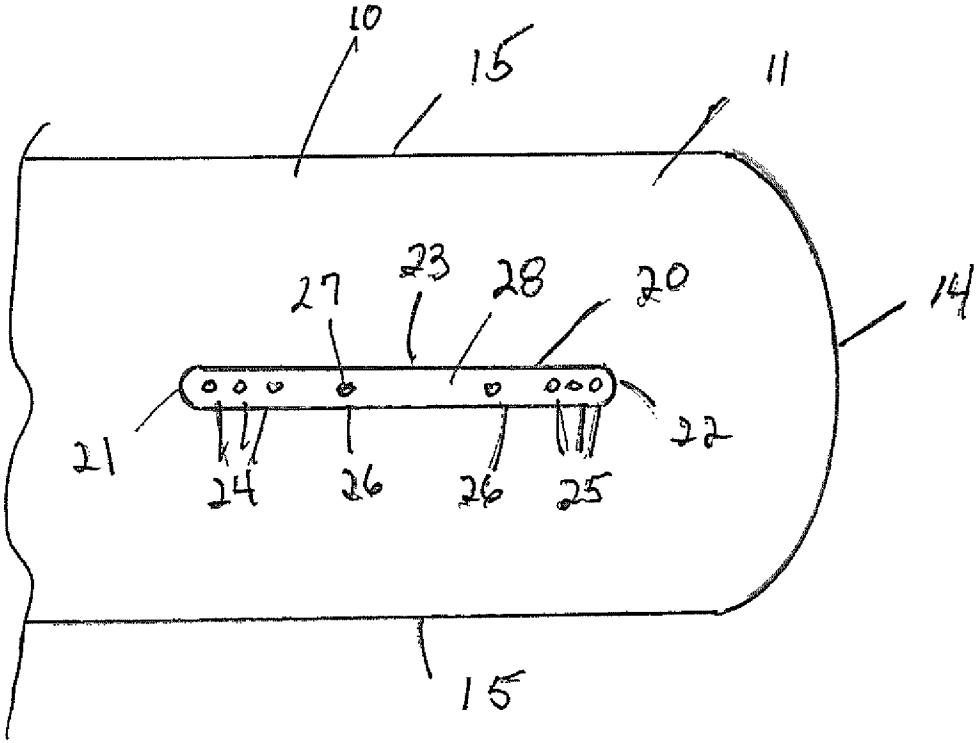
FIG. 3 is a top view of the base plate.
Figure 4B:
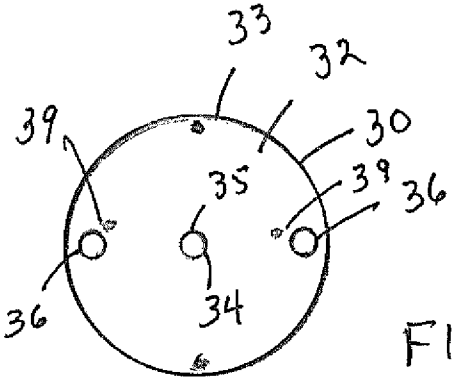
FIG. 4B is a bottom view of the bottom plate.
Figure 4C:
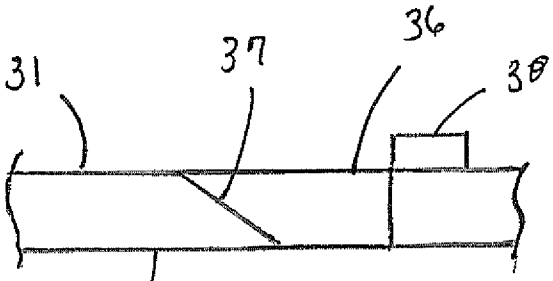
FIG. 4C is a cross sectional view of the bottom plate operator aperture.
Figure 4D:
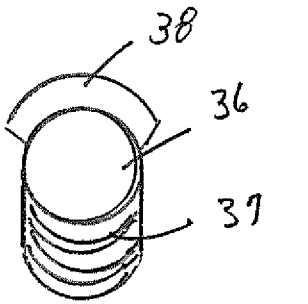
FIG. 4D is a close up view of the operator aperture.
Figure 4A:
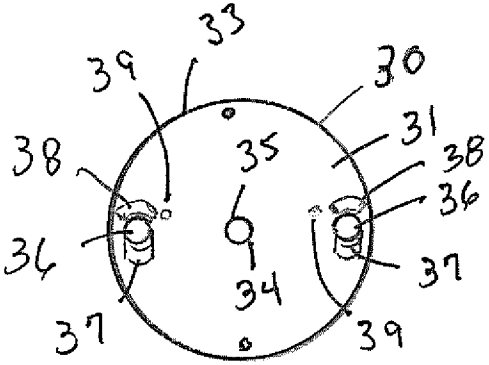
FIG. 4A is a top view of the bottom plate.

The foot repositioning system 1 is comprised, in part, of a flat, elongated mounting plate 20 having a forward portion 21, a rear portion 22 and a central portion 23, said forward and rear portions defining a mounting plate longitudinal axis parallel to the said board longitudinal axis. The mounting plate has a top surface 28 and an opposite bottom surface (not shown) joined to the sail board top surface 11. Mounting plate forward and rear portions have a plurality of apertures 24, 25 for fasteners joining the forward and rear portions to the sail board top surface 11. The mounting plate 20 also has a plurality of attachment apertures 26 adapted to receive attachment fasteners 27 from a circular bottom plate 30 thereby joining the circular bottom plate 30 to the mounting plate 20. The mounting plate 20 may be made from rubber, plastic or carbon fiber. The mounting plate may alternatively be joined to the sail board top with marine glue. See FIG. 3.

The foot repositioning system 1 is further comprised of said circular bottom plate 30 having a flat top surface 31, a flat under surface 32 and a perimeter edge 33. The bottom plate has a central holding aperture 34 at a bottom plate center 35. The bottom plate also has two operator apertures 36 formed therein 180 degrees apart. Each operator aperture 36 has a 180 degree side with a radial slope 37 extending upwardly from the circular bottom plate under surface 32 to the bottom plate top surface 31, generally parallel to the bottom plate perimeter edge 33 and in the radial direction of the other operator aperture slope. Each operator aperture 36 has a curved reinforcing stop element 38 attached to the bottom plate top surface 31 about the operator aperture, non-sloped side. The bottom plate 30 has a plurality of holding apertures 39 for attachment fasteners 27 joining the bottom plate 30 to the mounting plate 20. The bottom plate is preferably made from a carbon fiber material. Alternatively, the bottom plate may be mounted directly to the sailboard top surface with marine glue. See FIGS. 4A, 4B, 4C and 4D.

Figure 5:
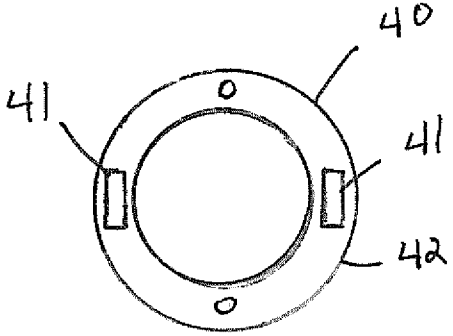
FIG. 5 is a top view of the padding ring.
Figure 6A:
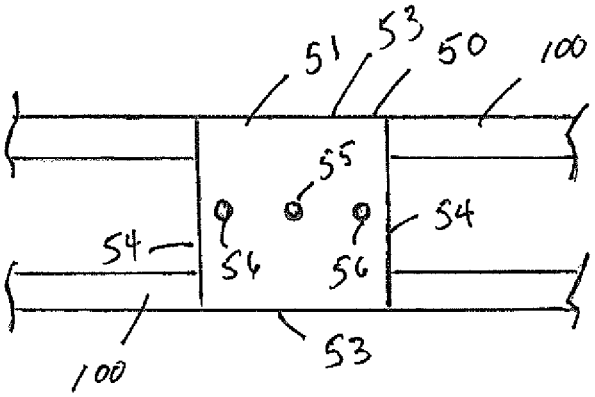
FIG. 6A is a top view of the top plate.
Figure 6B:
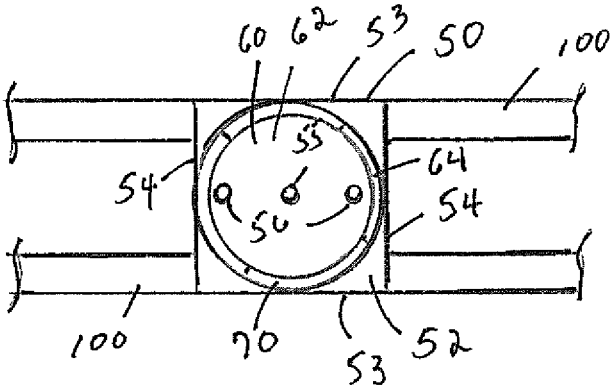
FIG. 6B is a bottom view of the top plate.

The foot repositioning system 1 is further comprised of a flat, padding ring spacer 40 attached to the bottom plate top surface 31. The ring spacer 40 has an outer diameter equal to the outer diameter of the bottom plate 30. The ring spacer has two apertures 41, 180 degrees apart near to a ring spacer perimeter edge 42. Each aperture 41 is shaped to openly fit over a bottom plate operator aperture 36, slope 37 and stop 38. See FIG. 5.

The foot repositioning system 1 is further comprised of a flat, generally rectangular top plate 50. The top plate has a top surface 51, an underside 52, two opposite longitudinal sides 53 and two opposite transverse sides 54. The top plate longitudinal sides 53 are aligned generally with the longitudinal axis of the sail board. The top plate has a central aperture 55, and two perimeter apertures 56, 180 degrees apart. The top plate has a pair of flat, elongated, parallel support rods 100 each joined to a top plate longitudinal side 53, each said support rod having opposite ends 101 and 102. The support rods 100 are in a spaced, parallel relationship with each other. Each pair of support rod ends 101 and 102 terminate in a foot plate 105. Each foot plate plate 105 has a top surface 106 and a foot strap 107 attached to the foot plate top surface 106. See FIGS. 1, 2, 6A and 6B.

Figure 7:
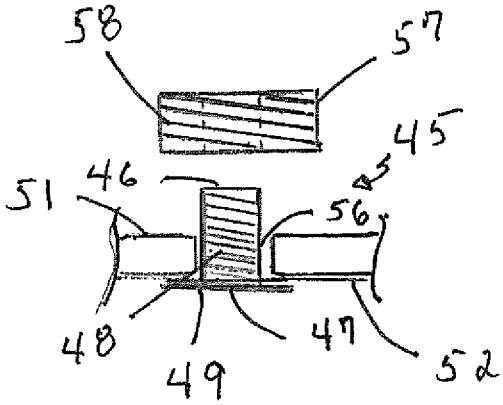
FIG. 7 is a cross sectional view of the reinforcing element.

Each top plate perimeter aperture 56 has a hollow, cylindrical reinforcing element 45 inserted there through. Each reinforcing element 45 has an open top 46, open bottom 47 and threaded side wall 48 extending from top 46 to bottom 47. The reinforcing element bottom 47 terminates in a radial flange 49. The reinforcing element radial flange 49 abuts the top plate underside 52. The reinforcing element top 46 protrudes through the top plate top surface 51. For each reinforcing element, an open nut 57 threadingly engages the reinforcing element side wall portion extending upward from the top plate top surface 51. The open nut 57 also has a plurality of external threads 58. See FIG. 7.

Figure 8A:
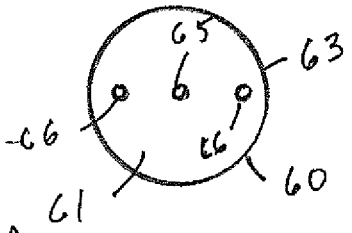
FIG. 8A is a top view of the top plate plastic disk.
Figure 8B:
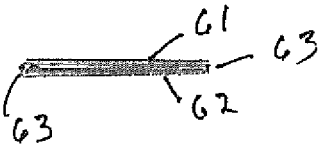
FIG. 8B is a side view of the plastic disk.
Figure 9:
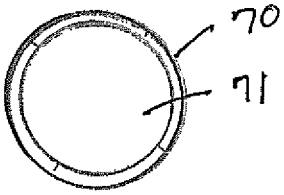
FIG. 9 is a bottom view of the holding ring.

The top plate underside 52 is padded with a circular plastic disk 60 having a top surface 61, a bottom surface 62 and a circumferential perimeter 63. The plastic disk has a central aperture 65 and two perimeter apertures 66 corresponding to the top plate apertures 55 and 56. A holding ring 70 of carbon fiber sections or solid plastic is mounted on the plastic disk bottom surface 62 on an annular surface portion 64 adjacent the plastic disk perimeter 63, said annular surface portion having a radial width less than the distance between a perimeter aperture 66 and plastic disk perimeter 63. The holding ring 70 is attached through the plastic disk to the top plate underside 52. The holding ring 70 has a circular central opening 71 exposing the top plate and plastic disk apertures 55, 56, 65, and 66. See FIGS. 8A, 8B and 9.

The top plate 50 with plastic disk 60 and holding ring 70 are placed over the bottom plate 30 with padding ring 40. The diameter of the bottom plate and padding ring are slightly less than the diameter of the holding ring central opening 71. The bottom plate 30, padding ring, top plate 50, and plastic disk 60 with holding fiber ring 70 are adapted to being joined together by a central fastener through the central apertures 34, and 55 of the bottom and top plates. The bottom plate operator apertures 36, top plate perimeter apertures 56 and plastic disk perimeter apertures 66 are aligned with each other.

The foot repositioning system 1 is further comprised of two locking pins 80, each contained within a locking pin housing 90. The locking pin housing 90 is a hollow cylindrical element having an sidewall 91, extending from an open locking pin housing bottom 92 to a locking pin housing open top 93. The sidewall 91 has an external surface 94 and an interior surface 95. The locking pin housing sidewall, top and bottom define a hollow locking pin housing interior 96. The locking pin housing interior surface 95 is threaded near to the locking housing bottom and is adapted to threadingly engage the open nut external threads 58. The locking pin housing external surface is threaded near to the locking pin housing top 93. A threaded cap 97 is adapted to threadingly engage the locking pin housing top 93.

Figure 11:
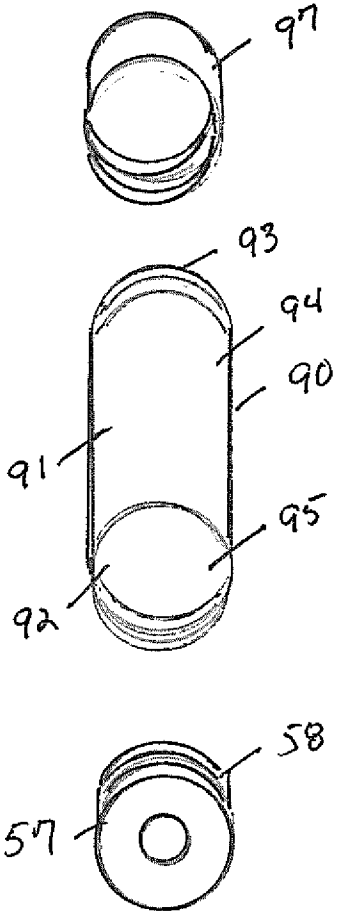
FIG. 11 is a side perspective view of the housing, cap and open nut.
Figure 10:
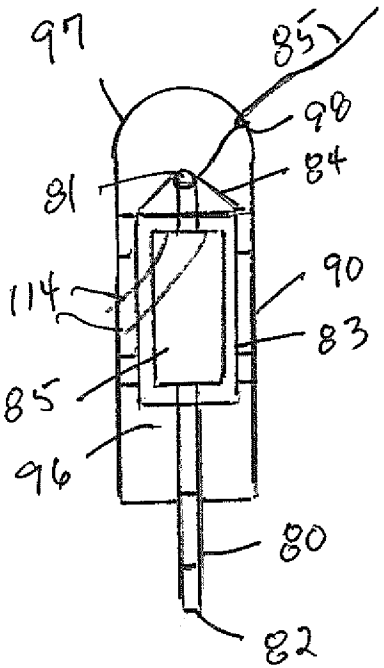
FIG. 10 is a cross sectional view of the locking pin and housing.

The locking pin 80 is an elongated solid cylinder having a top 81 and a bottom 82, said locking pin partly and slidably contained within a housing 83 holding an electromagnetic solenoid 85, said housing contained within the locking pin housing interior 96. The locking pin bottom 82 protrudes from the locking pin housing into and through the top plate reinforcing element and into the bottom plate operator aperture 36. The locking pin top 81 has an elastic material 84 connecting it to the solenoid housing 83 thereby nominally forcing the locking pin bottom 82 to protrude downwardly from the locking pin housing bottom 92. A spring may be substituted for the elastic material. See FIGS. 10 and 11.

Each solenoid 83 is remotely and individually activated causing the locking pin 80 to move upward out of the bottom plate operator aperture 36. The turning pressure on the top plate 50 from a sail board rider's feet through the foot plates 105 and support rods 100, 101, pressures the top plate 50 to spin. When a first solenoid is activated, a first locking pin is withdrawn from a first bottom plate operator aperture. The second locking pin bottom slides up the second operator aperture slope 37 freeing the top plate to turn clockwise 180 degrees until the second locking pin engages the first operator aperture stop 38 thereby halting an further turning and thereby becoming the first locking pin. This can be repeated or alternatively the second locking pin may be activated and withdrawn from a second bottom plate operator aperture freeing the top plate to turn counterclockwise 180 degrees until the first locking pin engages the second operator aperture stop.

Figure 12:
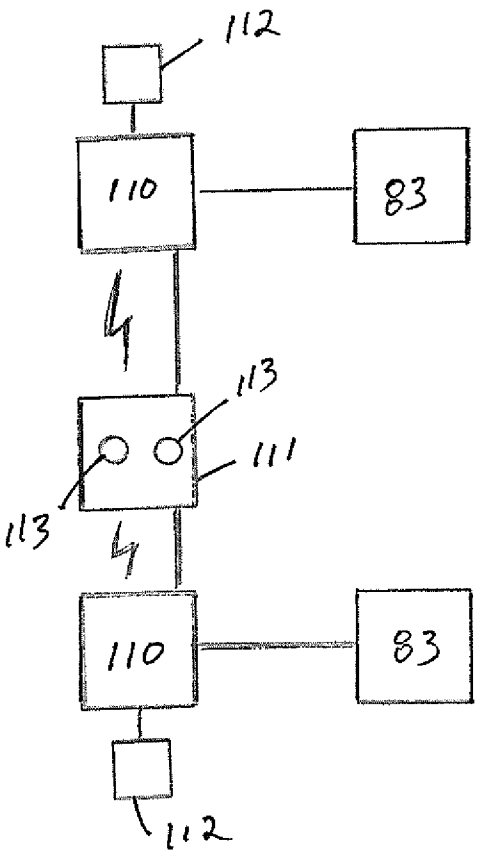
FIG. 12 is a diagrammic view of the electrical control for the locking pin.

Each solenoid 83 is electrically connected to an individual actuator 110 which pulse charges the connected solenoid 83 to electromagnetically move the locking pin 80 upwardly for a brief period. The actuator 110 may be activated by means of a remote controller 111 through a wireless RF frequency or through an attached wire. The controller 111 has an actuator button 113 for each locking pin 80. Each actuator 110 is physically contained, along with batteries 112, in a water proof container 116 preferably attached to one of the support rods 100 or 101 near to a top plate transverse side 54. A lanyard 85 may be attached to each locking pin top 81 through an aperture 98 in the locking pin housing threaded cap 97 to provide a manual means for operating the foot repositioning assembly 1. See FIG. 12.

It is understood that the above-described embodiments are merely illustrative of the application. Other embodiments may be readily devised by those skilled in the art which will embody the principles of the invention and fall within the spirit and scope thereof.

I claim:

1. A foot repositioning system for a sail board having a top surface, a bottom surface, a bow, a stern, and two elongated rails interconnecting the bow and stern, said bow and stern defining a sail board longitudinal axis, said sail board bottom surface having one or more skegs attached thereto generally near to the sail board stern, said sail board having a mast attached to the sail board top surface along a sail board central longitudinal axis, between a sail board longitudinal midpoint and the sail board bow, said foot repositioning system being attached to the sail board top surface between a sail board longitudinal midpoint and the sail board stern, said foot repositioning system comprising:

a circular bottom plate having a flat top surface, a flat under surface, a perimeter edge, a central holding aperture at a bottom plate center, and two operator apertures formed therein 180 degrees apart, each operator aperture having a 180 degree side with a radial slope extending upwardly from the circular bottom plate under surface to the bottom plate top surface, generally parallel to the bottom plate perimeter edge and in the radial direction of the other operator aperture slope, each operator aperture having a curved reinforcing stop element attached to the bottom plate top surface about the operator aperture, non-sloped side, wherein the bottom plate undersurface is joined to the sail board top surface;

a flat, generally rectangular top plate having a top surface, an underside, two opposite longitudinal sides and two opposite transverse sides, said top plate longitudinal sides aligned generally with the longitudinal axis of the sail board, said top plate has a central aperture and two perimeter apertures, 180 degrees apart, said top plate having a pair of flat, elongated, parallel support rods in a spaced, parallel relationship with each other, each joined to a top plate longitudinal side, each said support rod having opposite ends, said ends terminating in a foot plate, each foot plate having a top surface and a foot strap attached to the foot plate top surface;

wherein the top plate underside is padded with a circular plastic disk having a top surface, a bottom surface, a circumferential perimeter, a central aperture and two perimeter apertures corresponding to the top plate central and perimeter apertures;

a holding ring is mounted on the plastic disk bottom surface on a plastic disk annular surface portion adjacent the plastic disk perimeter, said annular surface portion having a radial width less than the distance between a perimeter aperture and plastic disk perimeter, said holding ring attached through the plastic disk to the top plate underside, said holding ring having a circular central opening exposing the top plate and plastic disk apertures;

wherein the top plate with plastic disk and holding ring are placed over the bottom plate; said bottom plate having a diameter less than the diameter of the holding ring central opening, said bottom plate, top plate, and plastic disk with holding ring are joined together by a central fastener through the central apertures of the bottom and top plates, wherein said bottom plate operator apertures, top plate perimeter apertures and plastic disk perimeter apertures are aligned with each other;

two locking pins, each contained within a locking pin housing, said locking pin housing comprised of a hollow cylindrical element having an sidewall, extending from an open locking pin housing bottom to a locking pin housing open top, said locking pin housing sidewall having an external surface and an interior surface, said locking pin housing sidewall, top and bottom defining a hollow locking pin housing interior, said locking pin housing interior surface threaded near to the locking housing bottom and adapted to threadingly engage an open nut external threads, said locking pin housing external surface threaded near to the locking pin housing top, wherein a threaded cap threadingly engages the locking pin housing top;

wherein each locking pin is an elongated solid cylinder having a top and a bottom, said locking pin partly and slidably contained within an electromagnetic solenoid contained within an interior housing, said interior housing contained within the locking pin housing interior, said locking pin bottom protruding from the locking pin housing into and through a top plate perimeter aperture and into a bottom plate operator aperture, wherein each locking pin top has an elastic material connecting the locking pin top to the interior housing thereby nominally forcing the locking pin bottom to protrude downwardly from the locking pin housing bottom;

wherein each solenoid is remotely and individually activated causing a specific locking pin to move upward out of a specific bottom plate operator aperture.

2. A foot repositioning system as recited in claim 1, wherein each solenoid is electrically connected to an individual actuator which pulse charges the connected solenoid to electromagnetically move the locking pin upwardly for a brief period.

3. A foot repositioning system as recited in claim 2, wherein:

said individual actuator is activated by means of a remote controller, said controller having an individual actuator button for each locking pin.

4. A foot repositioning system as recited in claim 3, wherein:

each actuator is physically contained, along with batteries, in a water proof container attached to the foot repositioning system.

5. A foot repositioning system as recited in claim 4, further comprising:

a lanyard attached to each locking pin top through an aperture in the locking pin housing.

6. A foot repositioning system as recited in claim 5, further comprising:

a flat, elongated mounting plate having a forward portion, a rear portion and a central portion, said forward and rear portions defining a mounting plate longitudinal axis parallel to the said board longitudinal axis, said mounting plate having a top surface and an opposite bottom surface joined to the sail board top surface said mounting plate inserted between the bottom plate under surface and sail board top surface, said mounting plate having a plurality of attachment apertures adapted to receive attachment fasteners from said circular bottom plate.

7. A foot repositioning system as recited in claim 6, further comprising:

a flat, padding ring spacer attached to the bottom plate top surface, said ring spacer having an outer diameter equal to the outer diameter of the bottom plate, said ring spacer having two apertures, 180 degrees apart near to a ring spacer perimeter edge, each said ring spacer aperture shaped to openly fit over a bottom plate operator aperture, slope and stop.

8. A foot repositioning system as recited in claim 7, further comprising:

a hollow, cylindrical reinforcing element inserted there through each top plate perimeter aperture, each said reinforcing element having an open top, open bottom and threaded side wall extending from top to bottom, said reinforcing element bottom terminating in a radial flange abutting the top plate underside, said reinforcing element top protruding through the top plate top surface, each reinforcing element having an open nut threadingly engaging the reinforcing element side wall portion extending upward from the top plate top surface, said open nut having a plurality of external threads adapted to engage the locking pin housing bottom.

9. A foot repositioning system as recited in claim 8, wherein:

said elastic material is a spring.

* * * * *